US011975370B2

(12) United States Patent
Han et al.

(10) Patent No.: US 11,975,370 B2
(45) Date of Patent: May 7, 2024

(54) PULSE CURRENT ASSISTED UNCANNED ROLLING METHOD FOR TITANIUM-TiAl COMPOSITE PLATES

(71) Applicant: Taiyuan University of Technology, Taiyuan (CN)

(72) Inventors: Jianchao Han, Taiyuan (CN); Yi Jia, Taiyuan (CN); Tao Wang, Taiyuan (CN); Zhongkai Ren, Taiyuan (CN); Yuanming Liu, Taiyuan (CN); Dongping He, Taiyuan (CN); Sha Li, Taiyuan (CN); Miao Guo, Taiyuan (CN)

(73) Assignee: Taiyuan University of Technology, Taiyuan (CN)

( * ) Notice: Subject to any disclaimer, the term of this patent is extended or adjusted under 35 U.S.C. 154(b) by 178 days.

(21) Appl. No.: 17/311,241

(22) PCT Filed: Oct. 23, 2020

(86) PCT No.: PCT/CN2020/123063
§ 371 (c)(1),
(2) Date: Jun. 4, 2021

(87) PCT Pub. No.: WO2021/078225
PCT Pub. Date: Apr. 29, 2021

(65) Prior Publication Data

US 2022/0241831 A1 Aug. 4, 2022

(30) Foreign Application Priority Data

Oct. 23, 2019 (CN) ..... 201911014125.9

(51) Int. Cl.
*B21B 1/38* (2006.01)
*B21B 3/00* (2006.01)
(Continued)

(52) U.S. Cl.
CPC ..... *B21B 1/38* (2013.01); *B21B 3/00* (2013.01); *B21B 15/0007* (2013.01);
(Continued)

(58) Field of Classification Search
CPC ..... B21B 1/38; B21B 3/00; B21B 15/0007; B21B 15/0035; B21B 2001/386;
(Continued)

(56) References Cited

FOREIGN PATENT DOCUMENTS

CN 202169276 U 3/2012
CN 105080999 A 11/2015
(Continued)

OTHER PUBLICATIONS

PCT/CN2020/123063, International Search Report and Written Opinion dated Jan. 28, 2021.

*Primary Examiner* — Anthony M Liang
*Assistant Examiner* — Danny N Kang
(74) *Attorney, Agent, or Firm* — Patterson + Sheridan, LLP

(57) ABSTRACT

The present disclosure provides a pulse current assisted uncanned rolling method for titanium-TiAl composite plates, including the following specific steps: 1. preparing titanium alloy sheets; 2. preparing TiAl alloy sheets; 3. uncanned lay-up; 4. pulse current assisted hot-rolling; 5. separation and subsequent processing, thus getting the titanium-TiAl composite plates. The composite plates are of good quality on the surface without oxide layer shedding, no cracks at the edges and the ends, with uniform and fine microstructures, good bonding interface and excellent mechanical properties.

8 Claims, 3 Drawing Sheets

(51) Int. Cl.

| | |
|---|---|
| ***B21B 15/00*** | (2006.01) |
| ***B22D 7/00*** | (2006.01) |
| ***C22C 14/00*** | (2006.01) |
| ***C22C 30/00*** | (2006.01) |
| ***C22F 1/18*** | (2006.01) |

(52) U.S. Cl.
CPC ..... *B21B 15/0035* (2013.01); *B22D 7/005* (2013.01); *C22C 14/00* (2013.01); *C22C 30/00* (2013.01); *C22F 1/183* (2013.01); *B21B 2001/386* (2013.01); *B21B 2003/001* (2013.01)

(58) Field of Classification Search
CPC ... B21B 2003/001; B21B 1/466; B22D 7/005; C22C 14/00; C22C 30/00; C22F 1/183; B21J 5/002; B21J 5/08; B21C 37/02
See application file for complete search history.

(56) References Cited

FOREIGN PATENT DOCUMENTS

| | | | | |
|---|---|---|---|---|
| CN | 105081323 | A | | 11/2015 |
| CN | 105108156 | A | | 12/2015 |
| CN | 105080999 | B | * | 8/2017 |
| CN | 107323030 | A | | 11/2017 |
| CN | 110711774 | A | | 1/2020 |
| JP | 4160126 | B2 | | 10/2008 |

* cited by examiner

PULSE CURRENT ASSISTED UNCANNED ROLLING METHOD FOR TITANIUM-TiAl COMPOSITE PLATES

This application claims priority to Chinese Patent Application No. 201911014125.9, entitled "pulse current assisted uncanned rolling method for titanium-TiAl composite plates", filed to China National Intellectual Property Administration on Oct. 23, 2019, the entire contents of which are incorporated herein by reference.

TECHNICAL FIELD

The present disclosure relates to the field of alloy material preparation, and specifically relates to a pulse current assisted uncanned rolling method for titanium-TiAl composite plates.

BACKGROUND

TiAl alloy (γ-TiAl-based intermetallic compound) is a novel lightweight and high temperature structural material, which has high specific strength and specific modulus, good high temperature creep resistance and oxidation resistance, the operating temperature of which can be up to 850° C., and the sheets of which have a wide application prospect in aerospace field. However, because TiAl alloy is a kind of material that is difficult to thermoplastic deformation, with small hot working window, so the material is prone to buckling and cracking during rolling; at the same time, the sheets has poor mechanical properties at room temperature, as well as poor machine capability and assembly ability, which seriously hinder the development and application of TiAl alloy sheets. Titanium alloy has good hot workability, as well as excellent plasticity and ductility at room temperature, but its working temperature range is low (~600° C.). Therefore, titanium-TiAl bimetal composite plates can give full play to the advantages of the two materials, and overcome the problems about the formation, mechanical properties and assembly of the intermetallic compound material by means of the properties of plastic metals, thereby having great application prospects in components with a certain temperature gradient and complex thermal environment in the aerospace field.

At present, titanium-TiAl composite plates are mainly prepared by means of foil metallurgy and can lay-up+hot-rolling. The foil metallurgy process includes foil hot-pressing method and foil pack rolling method. The feasibility of preparing titanium-TiAl laminated composites by hot pressing process of elemental foil sheets has been confirmed through a large number of experiments, but the composite plates prepared by such a process have small sizes, low strength and plasticity, which cannot meet the needs of actual working conditions; due to the poor coordination ability of titanium foil and aluminum foil to hot deformation, the foil pack rolling method may cause the rolled composite sheets to have large interior stress; at the same time, Al is nearly liquid at high temperature and easy to be extruded out during rolling, resulting in that the rolled sheets are greatly different from the designed composition, and the sheets may have uneven thicknesses and low quality. The hot-pack rolling process is complex, the packs have high cost, the size of the composite plates is small, and there are some differences between the deformations abilities of pack materials and metals to be rolled, which may lead to defects of the composite plates such as buckling, uneven thickness and the like. At the same time, in order to ensure the high temperature deformation ability of TiAl alloy, the rolling temperature is generally in a range of 1200° C.~1250° C., which is far higher than the thermal processing temperature range of titanium alloy. There are multiple rolling passes, leading to coarse microstructure of the titanium alloy. A large amount of fragile B2 (β0) phases are separated out of the bonding interface, which deteriorate the mechanical properties. In addition, there are great differences in the yield-strength ratio and the elasticity modulus of TiAl alloy and titanium alloy, resulting in that the difference of material rebounding is significant, thus presenting challenges for the coordinated deformation of titanium and TiAl.

SUMMARY

Aiming at the problems of small size, uneven thickness, large composition deviation, low strength and plasticity in the titanium-TiAl composite plates prepared by foil metallurgy, as well as the difficult problems in hot-pack rolling process including high cost, complex process, high rolling temperature, and the quality and performance of the composite plates needed to be further improved, the present disclosure provides a pulse current assisted uncanned rolling method for titanium-TiAl composite plates.

To solve the above technical problems, the present disclosure employs the following technical solutions:

A pulse current assisted uncanned rolling method for titanium-TiAl composite plates, including the following steps:

Step 1. Preparation of titanium alloy sheets:

a. Determining the titanium alloy types based on the requirement, melting the titanium alloy by a vacuum induction levitation melting process, to get cylindrical ingots, of which the diameter is ≥100 mm and the height is ≥180 mm;

b. Cutting off risers from the ingots and removing oxide skin from the surface by turn-milling technology, then holding billets in a box-type vacuum heat treatment furnace at 900° C.~1100° C. for 30~60 min, upsetting the titanium alloy billets with a hydraulic forging press at a strain rate of 0.01~0.05 $s^{-1}$, for which the total deformation is 70~80%; at the end of upsetting, holding the billets in the vacuum heat treatment furnace at 400° C.~500° C. for 2 h, and furnace cooling;

c. Removing oxide skin from the upset billets, flattening the surface, cutting the cores of forging discs and processing into standard rectangular blocks, chamfering the deformation front ends of the billets, holding in the box-type vacuum heat treatment furnace at 900° C.~1100° C. for 30~60 min, and then rolling at a rolling speed of 0.5~1.5 m/s, for which the pass reduction rate is 30%~40%, holding the passes back in the furnace at a holding temperature of 900° C.~1100° C. and for a period of 10~15 min, the total rolling deformation is 70%~80%, holding the rolled sheets in the vacuum heat treatment furnace at 400° C.~500° C. for 2 h, furnace cooling, to get the titanium alloy sheets;

Step 2. Preparation of TiAl alloy sheets:

a. Determining the TiAl alloy types based on the requirement, melting the TiAl alloy by a vacuum induction levitation melting process, to get cylindrical ingots, of which the diameter is ≥100 mm and the height is ≥180 mm;

b. Cutting off risers from the TiAl alloy ingots and then conducting hot isostatic pressing, then cutting off risers from the ingots and removing oxide skin from the surface by turn-milling technology, flattening upper and lower end faces;

c. Spraying high temperature anti-oxidation coating onto the circumferential face and the upper and lower end faces of cylindrical TiAl alloy billets, holding in the box-type vacuum heat treatment furnace at 1200° C.~1250° C. for 30~60 min, heating the upper and lower anvils of the press with a split cylindrical box-type resistance furnace to 600° C.~700° C., conducting uncanned near-isothermal upsetting on the TiAl alloy billets at a strain rate of 0.01~0.05 $s^{-1}$, for which the total deformation is 70~80%; at the end of upsetting, holding the billets in the vacuum heat treatment furnace at 900° C.~1000° C. for 2 h, furnace cooling;

d. Removing oxide skin from the upset billets, flattening the surface, cutting the cores of forging discs and processing into standard rectangular blocks, to get the TiAl alloy sheets;

Step 3. Uncanned lay-up:

a. Cutting off billets with certain dimensions from the titanium alloy and TiAl alloy sheets prepared in steps 1 and 2 by wire cut electrical discharge machining, in which the thickness ratio of titanium alloy to TiAl alloy is 1.2:1~2:1; cutting the bottom titanium alloy concave billets from the cores of forging discs in step 1, chamfering the ends of the billets, then conducting surface treatment on the titanium alloy and TiAl alloy billets by means of mechanical polishing until the surface roughness reaches Ra1.6~Ra0.8, then ultrasonic cleaning in an acetone solution for 5-10 min, and then taking out and drying;

b. Laying-up the surface-treated titanium alloy and TiAl alloy billets in a symmetric stacking manner, with the titanium alloy on the outside, evacuating and then welding on by a tungsten argon arc welding process, to get the titanium-TiAl alloy slabs to be rolled;

Step 4. Pulse current assisted hot-rolling:

a. Holding the titanium-TiAl alloy slabs to be rolled from step 3 in the vacuum box-type heat treatment furnace at 1050° C.~1150° C. for 30~60 min;

b. Taking the titanium-TiAl alloy slabs to be rolled out of the furnace for electroplastic rolling, in which pulse current is fed into the slabs away from the rolling inlet through a copper conductive clamp equipped with a graphite gasket, the rolling speed is 0.5~1.5 m/s, and the pass reduction rate is 15%~25%; holding the passes back in the furnace at a holding temperature of 1050° C.~1150° C. and for a period of 10~15 min, the total rolling deformation is 50%~60%;

c. Holding the rolled sheets in the vacuum heat treatment furnace at 900° C.~1000° C. for 2 h, furnace cooling, to get annealed titanium-TiAl composite plates;

Step 5. Separation and subsequent processing:

a. Trimming the annealed titanium-TiAl composite plates obtained from step 4 by means of mechanical processing, and separating the upper and lower composite plates;

b. Conducting surface treatment on the composite plates mechanically, polishing until the surface roughness reaches Ra1.6~Ra0.8, then ultrasonic cleaning in an acetone solution for 5~10 min, and then taking out and drying, to get the titanium-TiAl composite plates.

Preferably, the heat treating atmosphere in b and c of step 1 is argon atmosphere, of which the argon pressure is 0.95~1 MPa and the mass purity of argon is 99.99%.

Preferably, the atmosphere of hot isostatic pressing and heat treatment in b and c of step 2 is argon atmosphere, of which the argon pressure is 0.95~1 MPa and the mass purity of argon is 99.99%; the high temperature anti-oxidation coating in c of step 2 is a commercial product of 1500° C. type; standing treatment after spraying, in which for the standing treatment, the temperature is 50° C.~55° C., and the humidity is 50~60% RH.

Preferably, the hot isostatic pressing process is at 1230° C.~1260° C., at 100 MPa~150 MPa, under the protection of an argon atmosphere, holding for 3 h~4 h, tapping with the cooling of the furnace.

Preferably, the chamfered corner in a of step 3 is a round corner with an angle of 45° and a radius of 3~6 mm; the separating agent used in b of step 3 is nano-yttria coating; evacuating the air inside the lay-up through a vacuum pump.

Preferably, the heat treating atmosphere in a, b and c of step 4 is argon atmosphere, of which the argon pressure is 0.95~1 MPa and the mass purity of argon is 99.99%; feeding a large flow of argon when opening and closing the furnace door to ensure an inert atmosphere environment; the pulse current in b of step 4 has a frequency of 300 Hz~800 Hz, its wave form is rectangle, the voltage is 120 V, and the peak current is 100~200 $A \cdot mm^{-2}$; the insulation of the rolling mill stand is realized by ceramic insulation gaskets for the bearing seat.

Compared with the prior art, the present disclosure has the following beneficial effects:

1. Through large deformation near-isothermal upsetting pretreatment, the present disclosure can effectively improve the microstructural morphology of titanium alloy and TiAl alloy ingots, break as-cast dendrite, refine grains, as well as further overcome the problems of components and uneven grain size in the billets, and enhance the thermal deformation capacity.
2. The present disclosure employs a pulse current assisted rolling method, in which the pure eletroplastic effect of the pulse current can promote the dislocation and superdislocation motion capacity of metal materials, thus reducing the resistance to deformation of the material and improving the plastic deformation ability; and based on the higher electrical resistivity of titanium alloy and TiAl alloy as well as the Joule heating effect of pulse current, electric energy can be converted into heat energy, thus raising the temperature of slabs, reducing the temperature required for thermal deformation, thereby realizing the high-quality rolling of TiAl alloy.
3. The present disclosure employs uncanned lay-up, which breaks through the traditional canned treatment of billets, thus reducing the cost, simplifying the process, avoiding the problems of the absorption and rolling deformation of the canning materials and the poor coordination with the deformation of metals to be rolled, and improving the rolling efficiency.
4. The composite plates obtained in the present disclosure have uniform and fine grains, so they have good comprehensive mechanical properties and can be used directly or can be formed for the second time.

Figure 1:
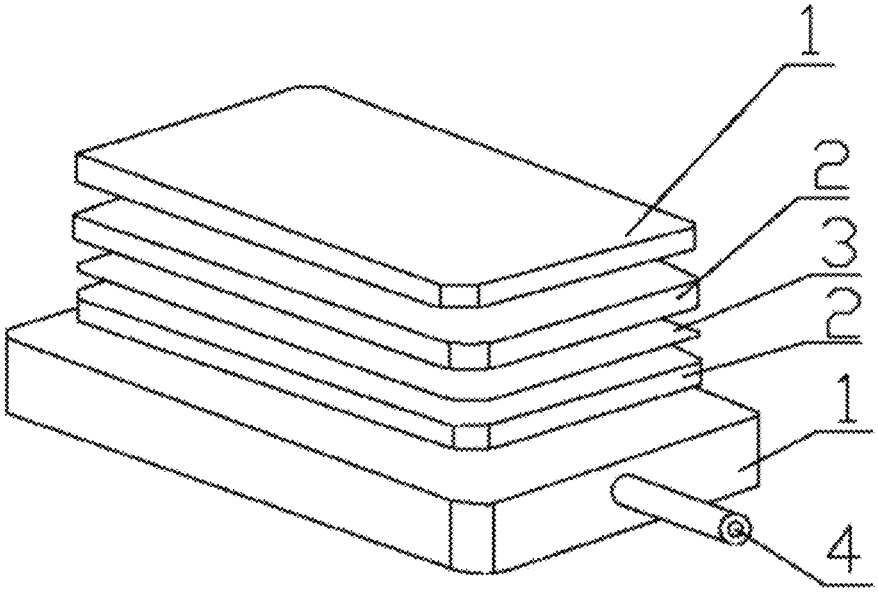
FIG. 1 is a schematic diagram showing the titanium-TiAl alloy lay-up in step 3.

The markers in FIG. 1 are as below:

1—Titanium alloy, 2—TiAl, 3—Separating agent, 4—Evacuating pipe.

DETAILED DESCRIPTION

The present disclosure will be further illustrated in combination with specific examples.

Example 1

TC4/Ti-44Al-8Nb-(B, Y) alloy composite plates can be prepared as below:

Step 1. Preparation of titanium alloy sheets:

a. Melting TC4 (Ti-6Al-4V) titanium alloy by a vacuum induction levitation melting process, to get cylindrical ingots, of which the diameter is 100 mm and the height is 180 mm;

b. Cutting off risers from the ingots and removing oxide skin from the surface by turn-milling technology, then holding the billets in a box-type vacuum heat treatment furnace at 950° C. for 30 min, upsetting the titanium alloy billets with a hydraulic forging press at a strain rate of 0.01 $s^{-1}$, for which the total deformation is 70%; at the end of upsetting, holding the billets in the vacuum heat treatment furnace at 400° C. for 2 h, furnace cooling;

c. Removing oxide skin from the upset billets, flattening the surface, cutting the cores of forging discs and processing into standard rectangular blocks, chamfering the deformation front ends of the billets, holding in a box-type vacuum heat treatment furnace at 950° C. for 30 min, and then rolling at a rolling speed of 1.5 m/s, for which the pass reduction rate is 40%, holding the passes back in the furnace at a holding temperature of 950° C. and for a period of 10 min, the total rolling deformation is 80%, holding the rolled sheets in the vacuum heat treatment furnace at 400° C. for 2 h, furnace cooling, to get the titanium alloy sheets.

The heat treating atmosphere in b and c of step 1 is argon atmosphere, of which the argon pressure is 1 MPa and the mass purity of argon is 99.99%;

Step 2. Preparation of TiAl alloy sheets:

a. Melting Ti-44Al-8Nb-(B, Y) alloy by a vacuum induction levitation melting process, to get cylindrical ingots, of which the diameter is 100 mm and the height is 180 mm;

b. Cutting off risers from the TiAl alloy ingots and then conducting hot isostatic pressing, the pressing process is at 1260° C., at 150 MPa, under the protection of an argon atmosphere, holding for 4 h, tapping with the cooling of the furnace; cutting off risers from the ingots and removing oxide skin from the surface by turn-milling technology, flattening the upper and lower end faces;

c. Spraying high temperature anti-oxidation coating onto the circumferential face and the upper and lower end faces of cylindrical TiAl alloy billets, holding in the box-type vacuum heat treatment furnace at 1250° C. for 60 min; heating the upper and lower anvils of the press with a split cylindrical box-type resistance furnace to 700° C., conducting uncanned near-isothermal upsetting on the TiAl alloy billets at a strain rate of 0.01 $s^{-1}$, for which the total deformation is 70%; at the end of upsetting, holding the billets in the vacuum heat treatment furnace at 900° C. for 2 h, furnace cooling;

d. Removing oxide skin from the upset billets, flattening the surface, cutting the cores of forging discs and processing into standard rectangular blocks, to get the TiAl alloy sheets.

The atmosphere of hot isostatic pressing and heat treatment in b and c of step 2 is argon atmosphere, of which the argon pressure is 1 MPa and the mass purity of argon is 99.99%; the high temperature anti-oxidation coating in c of step 2 is a commercial product of 1500° C. type; standing treatment after spraying, in which for the standing treatment, the temperature is 55° C., and the humidity is 60% RH.

Step 3. Uncanned lay-up:

a. Cutting off billets of 150 mm×100 mm from the titanium alloy and TiAl alloy sheets prepared in steps 1 and 2 by wire cut electrical discharge machining, in which the thicknesses of titanium alloy and TiAl alloy are 3 mm and 2.5 mm respectively; cutting the bottom titanium alloy concave billets from the cores of forging discs in step 1, chamfering the ends of the billets, then conducting surface treatment on the titanium alloy and TiAl alloy billets by means of mechanical polishing until the surface roughness reaches Ra1.6, then ultrasonic cleaning in an acetone solution for 10 min, and then taking out and drying;

b. Laying-up the surface-treated titanium alloy and TiAl alloy billets in a symmetric stacking manner, with the titanium alloy on the outside, evacuating and then welding on by a tungsten argon arc welding process, to get the titanium-TiAl alloy slabs to be rolled; the lay-up manner is as shown in FIG. 1.

The chamfered corner in a of step 3 is a round corner with an angle of 45° and a radius of 6 mm; the separating agent used in b of step 3 is nano-yttria coating; evacuating the air inside the lay-up through a vacuum pump.

Step 4. Pulse current assisted hot-rolling:

a. Holding the titanium-TiAl alloy slabs to be rolled from step 3 in the vacuum box-type heat treatment furnace at 1150° C. for 30 min;

b. Taking the titanium-TiAl alloy slabs to be rolled out of the furnace for electroplastic rolling, in which pulse current is fed into the slabs away from the rolling inlet through a copper conductive clamp equipped with a graphite gasket, the rolling speed is 0.5 m/s, and the pass reduction rate is 15%; holding the passes back in the furnace at a holding temperature of 1150° C. and for a period of 15 min, the total rolling deformation is 50%;

c. Holding the rolled sheets in the vacuum heat treatment furnace at 900° C. for 2 h, furnace cooling, to get annealed titanium-TiAl composite plates.

The heat treating atmosphere in a, b and c of step 4 is argon atmosphere, of which the argon pressure is 0.95~1 MPa and the mass purity of argon is 99.99%; feeding a large flow of argon when opening and closing the furnace door to ensure an inert atmosphere environment; the pulse current in b of step 4 has a frequency of 800 Hz, its wave form is rectangle, the voltage is 120 V, and the peak current is 200 $A \cdot mm^{-2}$; the insulation of the rolling mill stand is realized by ceramic insulation gaskets for the bearing seat.

Step 5. Separation and subsequent processing:

a. Trimming the annealed titanium-TiAl composite plates obtained from step 4 by means of mechanical processing, and separating the upper and lower composite plates;

b. Conducting surface treatment on the composite plates mechanically, polishing until the surface roughness reaches Ra1.6, then ultrasonic cleaning in an acetone solution for 10 min, and then taking out and drying, to get the titanium-TiAl composite plates.

Figure 2:
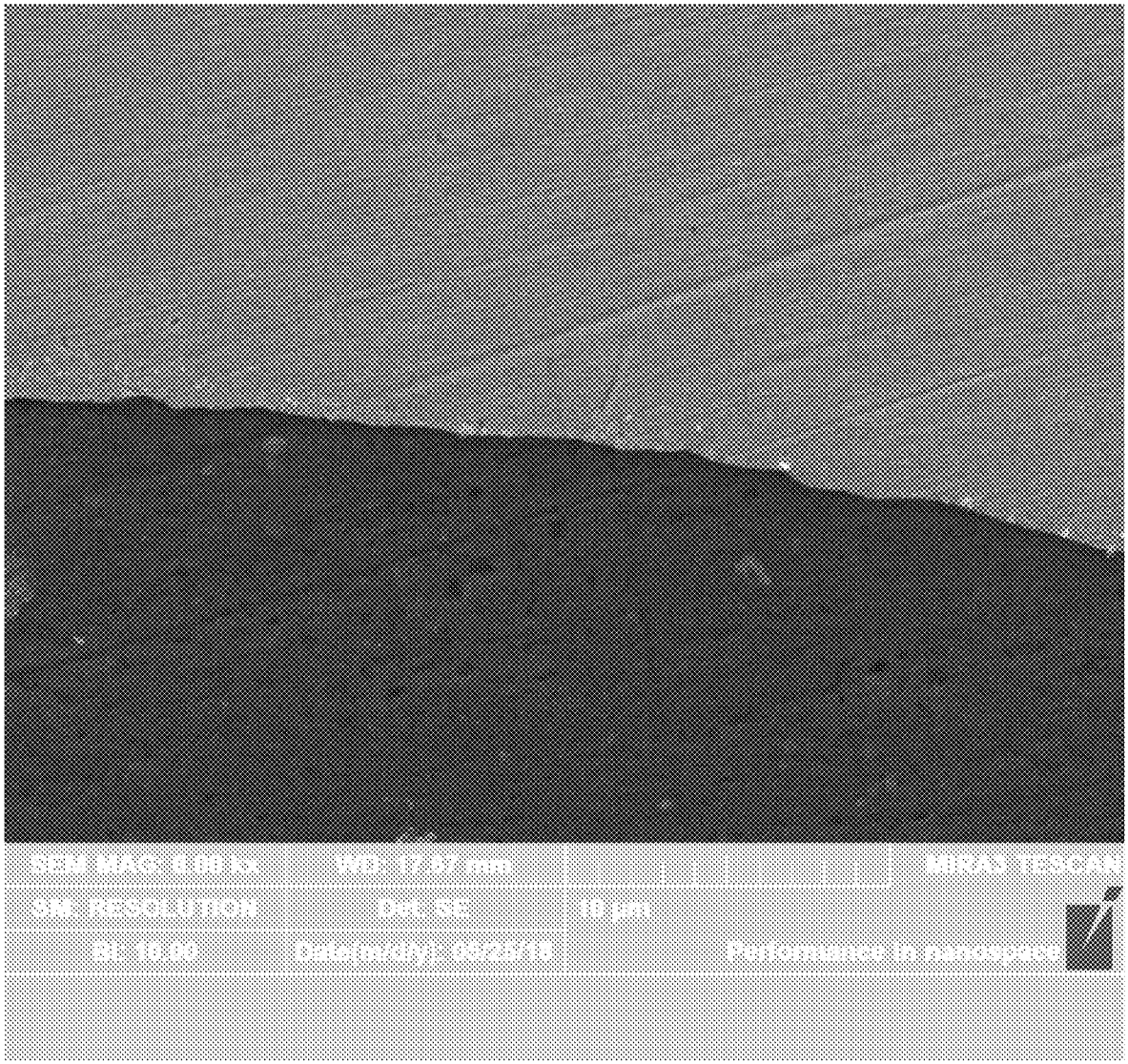
FIG. 2 is the SEM diagram of the titanium-TiAl composite plates obtained from step 5 of example 1.

The titanium-TiAl composite plates obtained from step 5 of example 1 have good bonding quality, with no obvious cracks on the interface, as shown in FIG. 2.

Example 2

BT16/Ti-43Al-4Nb-2Mo-2V alloy composite plates can be prepared as below:

Step 1. Preparation of titanium alloy sheets:

a. Melting B T16 (Ti-3Al-4.5V-5Mo) titanium alloy by a vacuum induction levitation melting process, to get cylindrical ingots, of which the diameter is 100 mm and the height is 180 mm;

b. Cutting off risers from the ingots and removing oxide skin from the surface by turn-milling technology, then holding the billets in a box-type vacuum heat treatment furnace at 1000° C. for 60 min, upsetting the titanium alloy billets with a hydraulic forging press at a strain rate of 0.05 $s^{-1}$, for which the total deformation is 80%; at the end of upsetting, holding the billets in the vacuum heat treatment furnace at 500° C. for 2 h, furnace cooling;

c. Removing oxide skin from the upset billets, flattening the surface, cutting the cores of forging discs and processing into standard rectangular blocks, chamfering the deformation front ends of the billets, holding in a box-type vacuum heat treatment furnace at 1000° C. for 60 min, and then rolling at a rolling speed of 1.5 m/s, for which the pass reduction rate is 40%, holding the passes back in the furnace at a holding temperature of 1000° C. and for a period of 15 min, the total rolling deformation is 80%, holding the rolled sheets in the vacuum heat treatment furnace at 500° C. for 2 h, furnace cooling, to get the titanium alloy sheets.

The heat treating atmosphere in b and c of step 1 is argon atmosphere, of which the argon pressure is 1 MPa and the mass purity of argon is 99.99%;

Step 2. Preparation of TiAl alloy sheets:

a. Melting Ti-43Al-4Nb-2Mo-2V alloy by a vacuum induction levitation melting process, to get cylindrical ingots, of which the diameter is 100 mm and the height is 180 mm;

b. Cutting off risers from the TiAl alloy ingots and then conducting hot isostatic pressing, the pressing process is at 1250° C., at 100 MPa, under the protection of an argon atmosphere, holding for 3 h, tapping with the cooling of the furnace; cutting off risers from the ingots and removing oxide skin from the surface by turn-milling technology, flattening the upper and lower end faces;

c. Spraying high temperature anti-oxidation coating onto the circumferential face and the upper and lower end faces of cylindrical TiAl alloy billets, holding in the box-type vacuum heat treatment furnace at 1250° C. for 30 min; heating the upper and lower anvils of the press with a split cylindrical box-type resistance furnace to 700° C., conducting uncanned near-isothermal upsetting on the TiAl alloy billets at a strain rate of 0.05 $s^{-1}$, for which the total deformation is 70%; at the end of upsetting, holding the billets in the vacuum heat treatment furnace at 900° C. for 2 h, furnace cooling;

d. Removing oxide skin from the upset billets, flattening the surface, cutting the cores of forging discs and processing into standard rectangular blocks, to get the TiAl alloy sheets.

The atmosphere of hot isostatic pressing and heat treatment in b and c of step 2 is argon atmosphere, of which the argon pressure is 1 MPa and the mass purity of argon is 99.99%; the high temperature anti-oxidation coating in c of step 2 is a commercial product of 1500° C. type; standing treatment after spraying, in which for the standing treatment, the temperature is 50° C., and the humidity is 50% RH.

Step 3. Uncanned lay-up:

a. Cutting off billets of 150 mm×100 mm from the titanium alloy and TiAl alloy sheets prepared in steps 1 and 2 by wire cut electrical discharge machining, in which the thicknesses of titanium alloy and TiAl alloy are 3 mm and 2 mm respectively; cutting the bottom titanium alloy concave billets from the cores of forging discs in step 1, chamfering the ends of the billets, then conducting surface treatment on the titanium alloy and TiAl alloy billets by means of mechanical polishing until the surface roughness reaches Ra1.6, then ultrasonic cleaning in an acetone solution for 5 min, and then taking out and drying;

b. Laying-up the surface-treated titanium alloy and TiAl alloy billets in a symmetric stacking manner, with the titanium alloy on the outside, evacuating and then welding on by a tungsten argon arc welding process, to get the titanium-TiAl alloy slabs to be rolled; the lay-up manner is as shown in FIG. 1.

The chamfered corner in a of step 3 is a round corner with an angle of 45° and a radius of 6 mm; the separating agent used in b of step 3 is nano-yttria coating; evacuating the air inside the lay-up through a vacuum pump.

Step 4. Pulse current assisted hot-rolling:

a. Holding the titanium-TiAl alloy slabs to be rolled from step 3 in the vacuum box-type heat treatment furnace at 1100° C. for 30 min;

b. Taking the titanium-TiAl alloy slabs to be rolled out of the furnace for electroplastic rolling, in which pulse current is fed into the slabs away from the rolling inlet through a copper conductive clamp equipped with a graphite gasket, the rolling speed is 1.5 m/s, and the pass reduction rate is 20%; holding the passes back in the furnace at a holding temperature of 1100° C. and for a period of 15 min, the total rolling deformation is 60%;

c. Holding the rolled sheets in the vacuum heat treatment furnace at 900° C. for 2 h, furnace cooling, to get annealed titanium-TiAl composite plates.

The heat treating atmosphere in a, b and c of step 4 is argon atmosphere, of which the argon pressure is 1 MPa and the mass purity of argon is 99.99%; feeding a large flow of argon when opening and closing the furnace door to ensure an inert atmosphere environment; the pulse current in b of step 4 has a frequency of 300 Hz, its wave form is rectangle, the voltage is 120 V, and the peak current is 100 $A \cdot mm^{-2}$; the insulation of the rolling mill stand is realized by ceramic insulation gaskets for the bearing seat.

Step 5. Separation and subsequent processing:

a. Trimming the annealed titanium-TiAl composite plates obtained from step 4 by means of mechanical processing, and separating the upper and lower composite plates;

b. Conducting surface treatment on the composite plates mechanically, polishing until the surface roughness reaches Ra1.6, then ultrasonic cleaning in an acetone solution for 10 min, and then taking out and drying, to get the titanium-TiAl composite plates.

Figure 3:
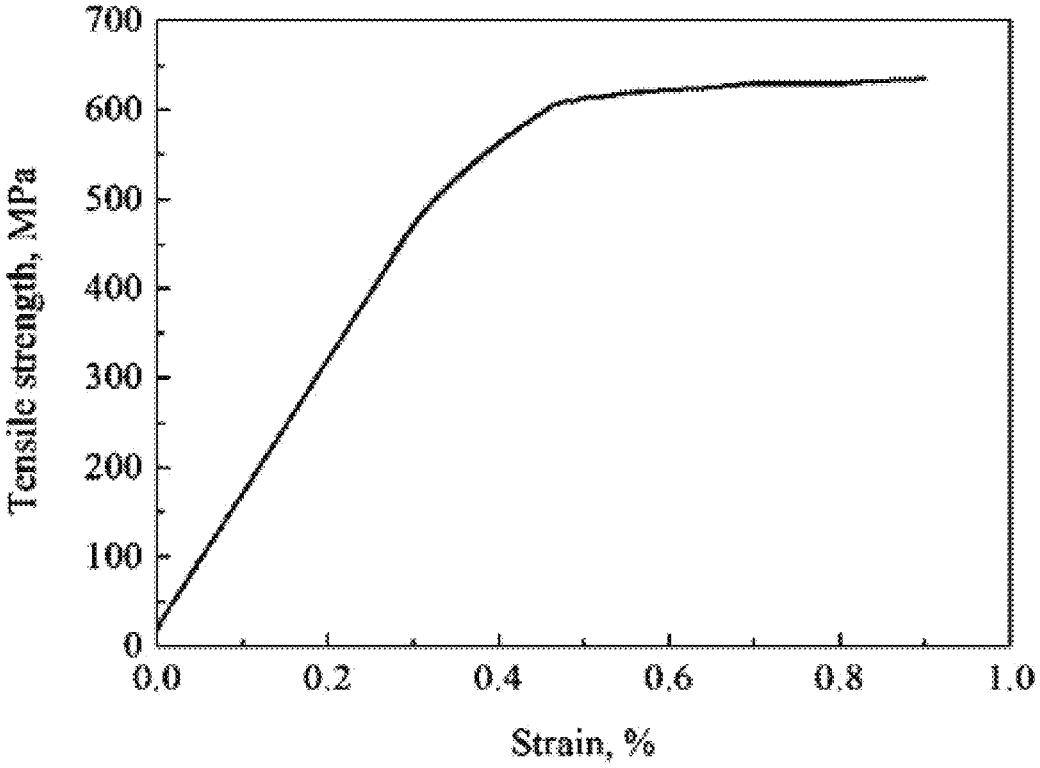
FIG. 3 is a diagram showing the tensile property of the titanium-TiAl composite plates obtained from step 5 of example 2 at room temperature.

The titanium-TiAl composite plates obtained from step 5 of example 2 have a size of 250 mm×90 mm×2 mm, the prepared titanium-TiAl composite plates have a tensile yield strength of 600 MPa at room temperature, and the elongation at room temperature is 0.9%, as shown in FIG. 3.

The foregoing is only preferable implementation of the present disclosure. It should be noted to persons with ordinary skills in the art that several improvements and modifications can be made without deviating from the principle of the present disclosure, which are also considered as the protection scope of the present disclosure.

What is claimed is:

1. A pulse current assisted uncanned rolling method for titanium-TiAl composite plates, comprising the following steps:

step 1, preparation of titanium alloy sheets:

a. melting a titanium alloy by a vacuum induction levitation melting process, to obtain cylindrical ingots, wherein the cylindrical ingots have a diameter of ≥100 mm and a height of ≥180 mm;

b. cutting off risers from the ingots and removing oxide skin from the surface by turn milling to obtain titanium alloy billets, then holding the titanium alloy billets in a box-type vacuum heat treatment furnace at 900° C.~1100° C. for 30~60 min, upsetting the titanium alloy billets with a hydraulic forging press at a strain rate of 0.01~0.05 $s^{-1}$, for which the total deformation is 70~80%; at the end of upsetting, holding the billets in the vacuum heat treatment furnace at 400° C.~500° C. for 2 h, and furnace cooling the billets to obtain upset billets;

c. removing oxide skin from the upset billets, flattening the surface, cutting the cores of forging discs and processing into standard rectangular blocks, chamfering the deformation front ends of the upset billets, holding in the box-type vacuum heat treatment furnace at 900° C.~1100° C. for 30~60 min, and then rolling at a rolling speed of 0.5~1.5 m/s, for which the pass reduction rate is 30%~40%, holding the passes back in the furnace at a holding temperature of 900° C.~1100° C. and for a period of 10~15 min, the total rolling deformation is 70%~80%, holding the rolled sheets in the vacuum heat treatment furnace at 400° C.~500° C. for 2 h, and furnace cooling the rolled sheets to obtain titanium alloy sheets;

step 2, preparation of TiAl alloy sheets:

a. melting a TiAl alloy by a vacuum induction levitation melting process, to get cylindrical ingots, wherein the cylindrical ingots have a diameter of ≥100 mm and a height of ≥180 mm;

b. cutting off risers from the TiAl alloy ingots and then conducting hot isostatic pressing, then cutting off risers from the ingots and removing oxide skin from the surface by turn milling, and flattening the upper and lower end faces of the TiAl alloy ingots;

c. spraying high temperature anti-oxidation coating onto the circumferential face and the upper and lower end faces of cylindrical TiAl alloy billets, holding in the box-type vacuum heat treatment furnace at 1200° C.~1250° C. for 30~60 min, heating the upper and lower anvils of the press with a split cylindrical box-type resistance furnace to 600° C.~700° C., conducting uncanned near-isothermal upsetting on the TiAl alloy billets at a strain rate of 0.01~0.05 $s^{-1}$, for which the total deformation is 70~80%; at the end of upsetting, holding the billets in the vacuum heat treatment furnace at 900° C.~1000° C. for 2 h, furnace cooling;

d. removing oxide skin from the upset billets, flattening the surface, cutting the cores of forging discs and processing into standard rectangular blocks, to obtain the TiAl alloy sheets;

step 3, uncanned lay-up:

a. cutting off billets with certain dimensions from the titanium alloy and TiAl alloy sheets prepared in steps 1 and 2 by wire cut electrical discharge machining, in which the thickness ratio of titanium alloy to TiAl alloy is 1.2:1~2:1; cutting the bottom titanium alloy concave billets from the cores of forging discs in step 1, chamfering the ends of the billets, then conducting surface treatment on the titanium alloy and TiAl alloy billets by means of mechanical polishing until the surface roughness reaches Ra1.6-Ra0.8, then ultrasonic cleaning in an acetone solution for 5~10 min, and then taking out and drying;

b. laying-up the surface-treated titanium alloy and TiAl alloy billets in a symmetric stacking manner, with the titanium alloy on the outside, evacuating and then welding on by a tungsten argon arc welding process, to get the titanium-TiAl alloy slabs to be rolled;

step 4, pulse current assisted hot-rolling:

a. holding the titanium-TiAl alloy slabs to be rolled from step 3 in the vacuum box-type heat treatment furnace at 1050° C.~1150° C. for 30~60 min;

b. taking the titanium-TiAl alloy slabs to be rolled out of the furnace for electroplastic rolling, in which pulse current is fed into the slabs away from the rolling inlet through a copper conductive clamp equipped with a graphite gasket, the rolling speed is 0.5~1.5 m/s, and the pass reduction rate is 15%~25%; holding the passes back in the furnace at a holding temperature of 1050° C.~1150° C. and for a period of 10~15 min, the total rolling deformation is 50%~60%;

c. holding the rolled sheets in the vacuum heat treatment furnace at 900° C.~1000° C. for 2 h, furnace cooling, to get annealed titanium-TiAl composite plates; and step 5, separation and subsequent processing:

a. trimming the annealed titanium-TiAl composite plates obtained from step 4 by means of mechanical processing, and separating the upper and lower composite plates;

b. conducting surface treatment on the composite plates mechanically, polishing until the surface roughness reaches Ra1.6~Ra0.8, then ultrasonic cleaning in an acetone solution for 5~10 min, and then taking out and drying, to get the titanium-TiAl composite plates.

2. The pulse current assisted uncanned rolling method for titanium-TiAl composite plates according to claim 1, wherein, the titanium alloy types in step 1 comprise TC4 (Ti-6Al-4V) titanium alloy or BT16 (Ti-3Al-4.5V-5Mo) titanium alloy; the TiAl alloy types in step 2 comprise Ti-44Al-8Nb-(B,Y) alloy or Ti-43Al-4Nb-2Mo-2V alloy.

3. The pulse current assisted uncanned rolling method for titanium-TiAl composite plates according to claim 1, wherein, the heat treating atmosphere in b and c of step 1 is argon atmosphere, of which the argon pressure is 0.95~1 MPa and the mass purity of argon is 99.99%.

4. The pulse current assisted uncanned rolling method for titanium-TiAl composite plates according to claim 1, wherein, the atmosphere of hot isostatic pressing and heat treatment in b and c of step 2 is argon atmosphere, of which the argon pressure is 0.95~1 MPa and the mass purity of argon is 99.99%.

5. The pulse current assisted uncanned rolling method for titanium-TiAl composite plates according to claim 1, wherein, the hot isostatic pressing process is: the hot isostatic pressing temperature is 1230° C.~1260° C., the pressure is 100 MPa~150 MPa, under the protection of an argon atmosphere, holding for a period of 3 h~4 h, and tapping with the cooling of the furnace.

6. The pulse current assisted uncanned rolling method for titanium-TiAl composite plates according to claim 1, wherein, the chamfered corner in a of step 3 is a round corner with an angle of 45° and a radius of 3~6 mm; evacuating the air inside the lay-up through a vacuum pump.

7. The pulse current assisted uncanned rolling method for titanium-TiAl composite plates according to claim 1, wherein, the heat treating atmosphere in a, b and c of step 4 is argon atmosphere, of which the argon pressure is 0.95~1 MPa and the mass purity of argon is 99.99%; feeding a large flow of argon when opening and closing the furnace door to ensure an inert atmosphere environment; the pulse current in b of step 4 has a frequency of 300 Hz~800 Hz, its wave form is rectangle, the voltage is 120 V, and the peak current is 100~200 $A \cdot mm^{-2}$; the insulation of the rolling mill stand is realized by ceramic insulation gaskets for the bearing seat.

8. The pulse current assisted uncanned rolling method for titanium-TiAl composite plates according to claim 4, wherein, the hot isostatic pressing process is: the hot isostatic pressing temperature is 1230° C.~1260° C., the pressure is 100 MPa~150 MPa, under the protection of an argon atmosphere, holding for a period of 3 h~4 h, and tapping with the cooling of the furnace.

* * * * *